US005178321A

United States Patent [19]

Majewski

[11] Patent Number: 5,178,321

[45] Date of Patent: Jan. 12, 1993

[54] MAILBOX COVER

[76] Inventor: Bernadette A. Majewski, 25 Verdun Pla., Cheektowaga, N.Y. 14225

[21] Appl. No.: 834,805

[22] Filed: Feb. 13, 1992

[51] Int. Cl.[5] ..... B65D 91/00

[52] U.S. Cl. ..... 232/17

[58] Field of Search ..... 232/17, 38, 39

[56] References Cited

U.S. PATENT DOCUMENTS

| | | | |
|---|---|---|---|
| 743,104 | 11/1903 | Roesch | 232/39 |
| 3,107,848 | 10/1963 | Penta | 232/17 |
| 4,244,512 | 6/1981 | Wise | 232/17 |
| 4,368,842 | 1/1983 | DeLange | 232/39 |
| 4,375,869 | 3/1983 | Hatch | 232/17 |
| 4,712,731 | 12/1987 | Gramelspacher | 232/17 |
| 4,813,595 | 3/1989 | Johns, Jr. et al. | 232/17 |
| 4,991,769 | 2/1991 | Todd | 232/17 |
| 5,000,379 | 3/1991 | LaRue | 232/17 |
| 5,035,356 | 7/1991 | Granger | 232/17 |
| 5,054,685 | 10/1991 | Roach | 232/38 |

*Primary Examiner*—Renee S. Luebke
*Assistant Examiner*—F. Saether
*Attorney, Agent, or Firm*—Richard C. Litman

[57] ABSTRACT

A cover is provided to envelope a regulation mailbox. A cutout is provided in the cover to permit the indicating flag of the mailbox to pass through a side portion of the cover and a cutout is made in the bottom portion of the cover to permit the same to substantially surround the mailbox post. Securing devices, such as snaps, are provided to secure the cover to the mailbox. Side portions may display indicia, such as for indicating the name and address of the owner of the mailbox as well as decorative designs or patterns. The indicia and designs may be stitched onto the cover. Skirts may be provided integral with the two side portions allowing more space to receive further indicia and designs.

12 Claims, 3 Drawing Sheets

MAILBOX COVER

FIELD OF THE INVENTION

The present invention relates to a covering for a mailbox. More specifically, the present invention relates to a mailbox cover designed to receive indicia and specific ornamental designs.

DESCRIPTION OF THE PRIOR ART

Devices for covering an existing mailbox are known in the art. U.S. Pat. No. 3,107,848 issued on Oct. 22, 1963 to Michael G. Penta discloses an encapsulated mailbox. The invention of Penta relates to a mailbox being substantially covered or encapsulated in a plastic spaced-apart covering or sheath. The outer cover is transparent, plastic and waterproof. Indicia representing name and address are shown in a second embodiment which relates to covering a house mounted mailbox.

U.S. Pat. No. 4,712,731 issued on Dec. 15, 1987 to George W. Grammelspacher discloses a mailbox structure. The mailbox structure is characterized by a housing or body, wrapped or overlaid with a thin decorative exterior grade and preservative treated plywood. The plywood is described of the type known as decorative exterior grade type. The plywood is described to be treated with, for example, a mildewcide, insecticide, fungicide, and/or water repellent. These treatments are designed to increase the lifetime of the invention to outside exposure.

U.S. Pat. No. 4,813,595 issued on Mar. 21, 1989 to Benjamin Johns, Jr. and Patrick Haynes, Jr. discloses a mailbox for receiving decorative overlays. This invention is drawn to mount readily replaceable decorative overlay. A mailbox is provided with means to mountably receive decorative overlays in such a way where the decorative overlay can be easily removed, if desired, and replaced by another.

U.S. Pat. No. 5,000,379 issued on Mar. 19, 1991 to Benjamin L. LaRue discloses a mailbox cover. A rectangular paper or plastic film sheet has a pressure sensitive backing for sticking onto the curved top of a regulation mailbox. The front face is printed with decorative graphics arranged to be seen from both sides. Stick on letters and numbers are disclosed to be stuck on the overlay to represent a name and address. It is further disclosed that the cover may be torn in appropriate places to permit the indicating flag to be used.

None of the above referenced devices, considered either singly or in combination, is seen to suggest the instant invention as claimed.

SUMMARY OF THE INVENTION

The present invention is drawn to a inexpensive cloth covering for an existing rural mailbox. The covering is designed to receive, preferably by stitchings, decorative patterns of any design, as well as indicia representing name and address. This stitching gives a positive structure to the cloth, leaving the letters, numerals, and decorative lines raised upon the cloth. A curved cutout is provided in the cloth in order to receive provide passage for and permit movement of the indicator flag. Several embodiments of the instant invention are presented. A short version is designed to envelope the mailbox and be secured thereon. A cutout is provided in a undersection to permit the cloth section substantially surround the pole which supports the mailbox above the ground. The long version is provided with right and left flaps which extend beyond the right and left side and below the bottom of the existing mailbox. The undersection extends laterally from an inner surface of the right skirt to an inner surface of the left skirt which completes the enclosure of the existing mailbox structure by substantially covering the bottom of the existing mailbox. Again a cutout is provided in the undersection to permit the undersection to substantially surround the pole which supports the mailbox above the ground.

Accordingly, one object of the present invention is to provide a cloth covering for a mailbox, with a curved cutout therein designed to receive and permit the motion of the indicator flag.

Another object of the present invention is to provide a wrap around cloth structure which covers the tops, the right side, left side, bottom side and rear side of a mailbox, and has means to be securable thereto.

Another object of the present invention is to provide a cloth cover for a mailbox designed to receive indicia and decorative patterns, preferably by stitching, which permits customizing of the cloth cover.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
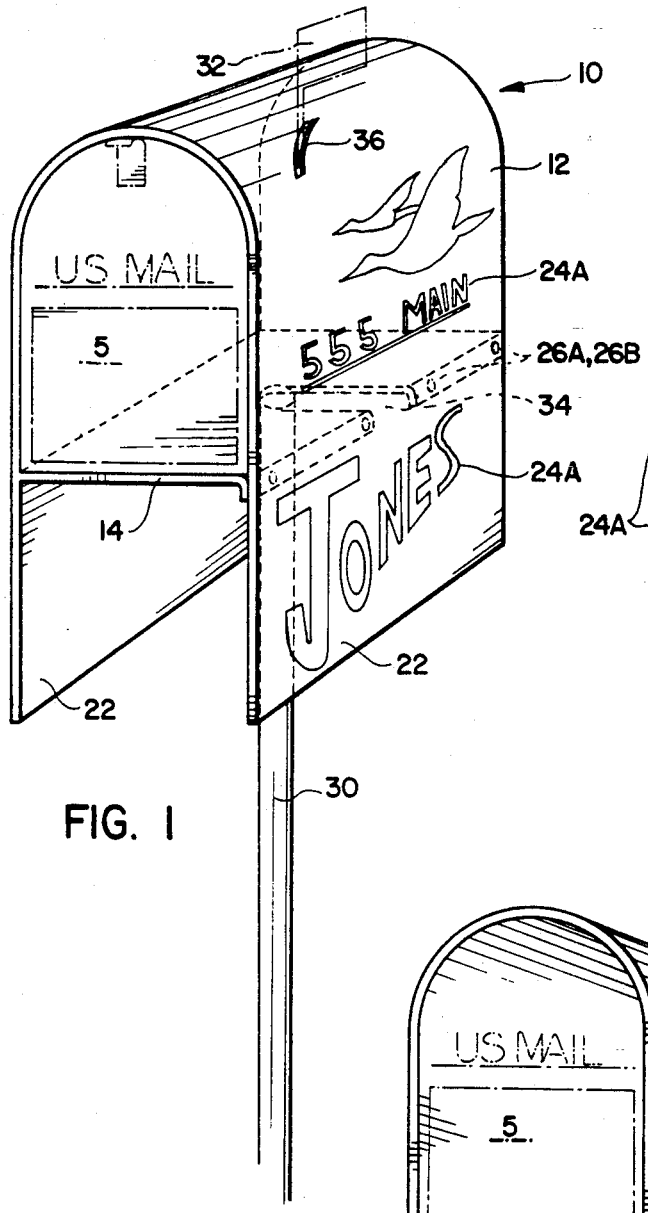
FIG. 1 shows an environmental perspective view of the first embodiment of the instant invention.
Figure 2:
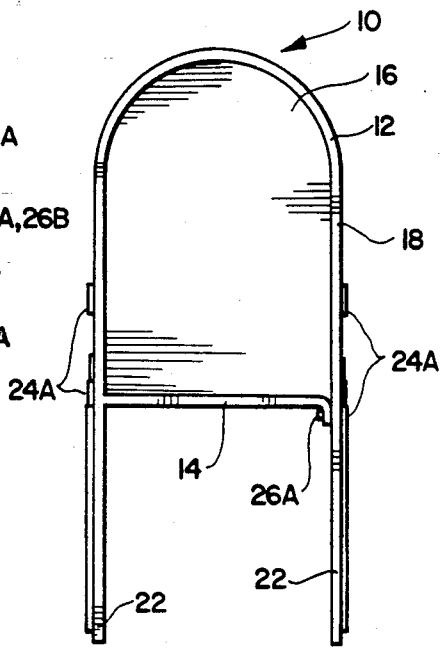
FIG. 2 shows a front view of the first embodiment of the instant invention.
Figure 3:
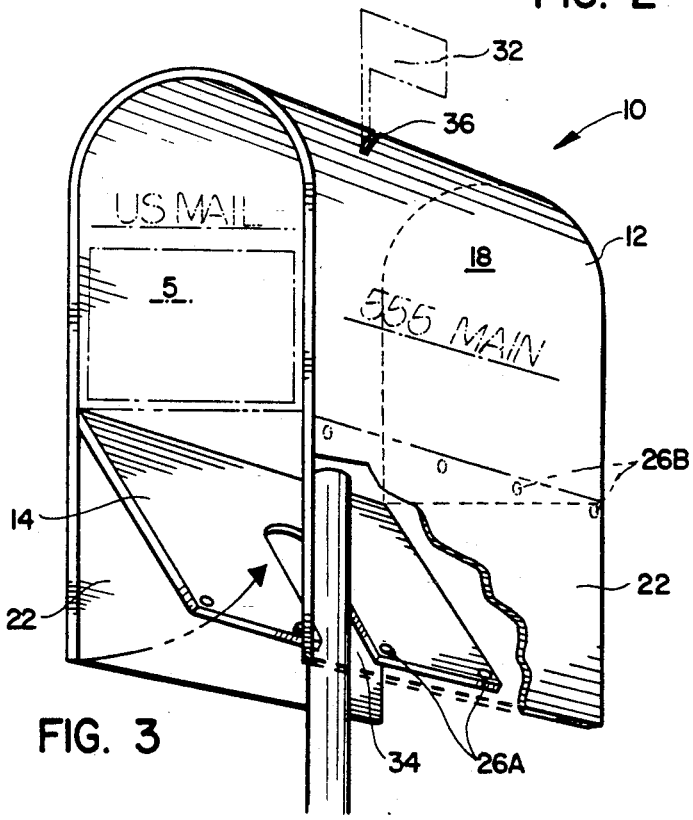
FIG. 3 shows a perspective view of the first embodiment of the instant invention, showing the undersection covering the bottom of the mailbox.
Figure 8:
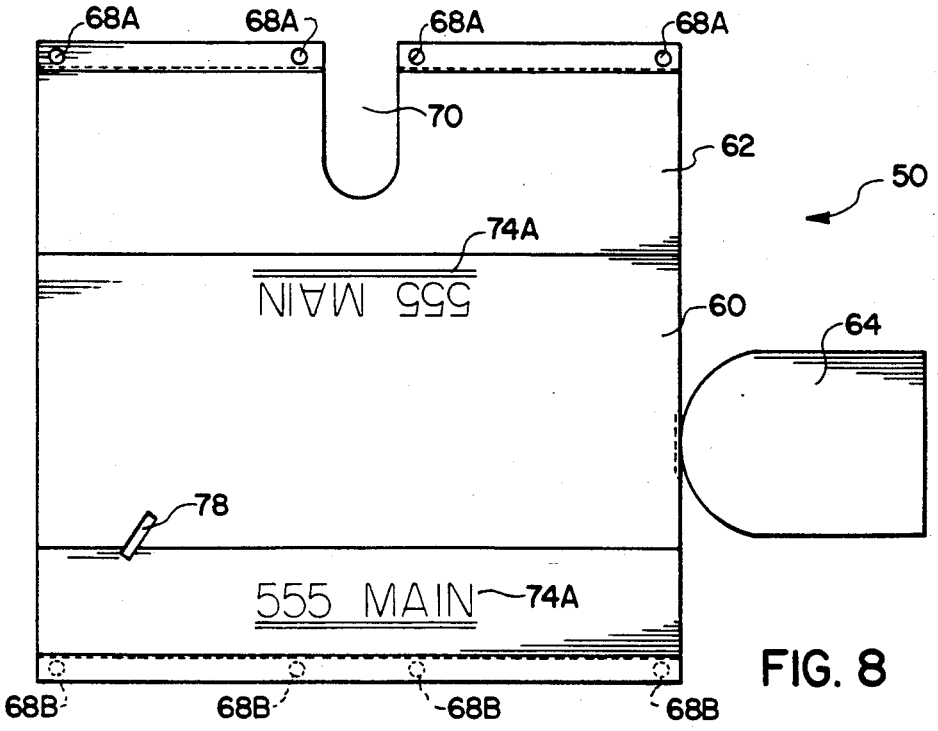
FIG. 8 shows a top plan view of the second embodiment of the instant invention.
Figure 7:
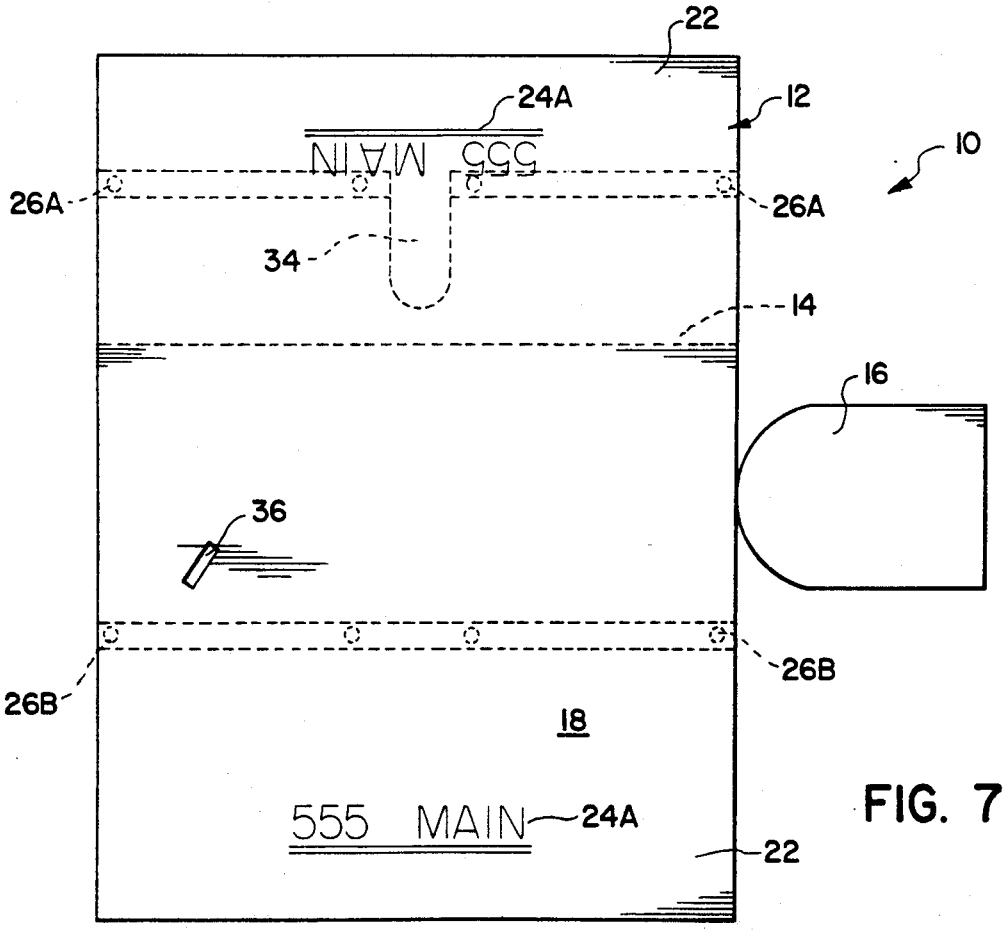
FIG. 7 shows a top plan view of the first embodiment of the instant invention.

Now, referring to the drawings, FIGS. 1-3 and 8 show the present invention is drawn to a mailbox cover 10 which comprises a piece of cloth. The cloth cover 10 is designed to cover a U.S. Postal Service regulation mailbox 5. The cover 10 will cover the right side, the left side, the top, the bottom, as well as the rear or end wall of the mailbox 5. The cover 10, will be discussed in terms of a first and second generally rectangular sheet 12,14 and an end sheet 16. An outer surface 18 of the first sheet 12 is designed to receive indicia 24A as well as decorative patterns 24B. The indicia 24A and patterns 24B could be customized to reflect the name and address of the owner of the mailbox 5 as well as a pattern of their choice. The indicia 24A and patterns 24B could be stitched into the cloth, providing raised lettering, which is a positive structural element.

The second sheet 14 is pivotally attached to the first sheet 12. A cutout 34 is provided through the second sheet 14 18 which would permit the cover 10 to come flush to the mailbox 5. The cutout 34 is dimensioned in such a manner to permit the second sheet 14 18 to pass by the mailbox post 30 which supports the mailbox 5. This cutout 34 can be made in such a manner to accommodate any standard mailbox post 30.

A cutout 36 may be provided in the first sheet 12 which would permit a flag indicator 32 to pass therethrough and would allow the flag indicator 32 to move through its full range of motion. This cutout 36 is curved and can be made in such a manner to accommodate any standard flag indicator 32.

The second sheet 14 connects to the first sheet 12 adjacent to the intersection of the bottom and the right side of the mailbox 5 by snap connection devices 26A, 26B 26. In this embodiment, male snaps 26A located on the second sheet 14 mate with female snaps 26B located on the first sheet 12. This secures the cover 10 firmly to the mailbox 5.

An extension extends beyond both the right and left sides of the mailbox 5 and below the bottom of the mailbox 5. This provides a right and left skirt 22 for indicia 24A and patterns 24B.

Figure 4:
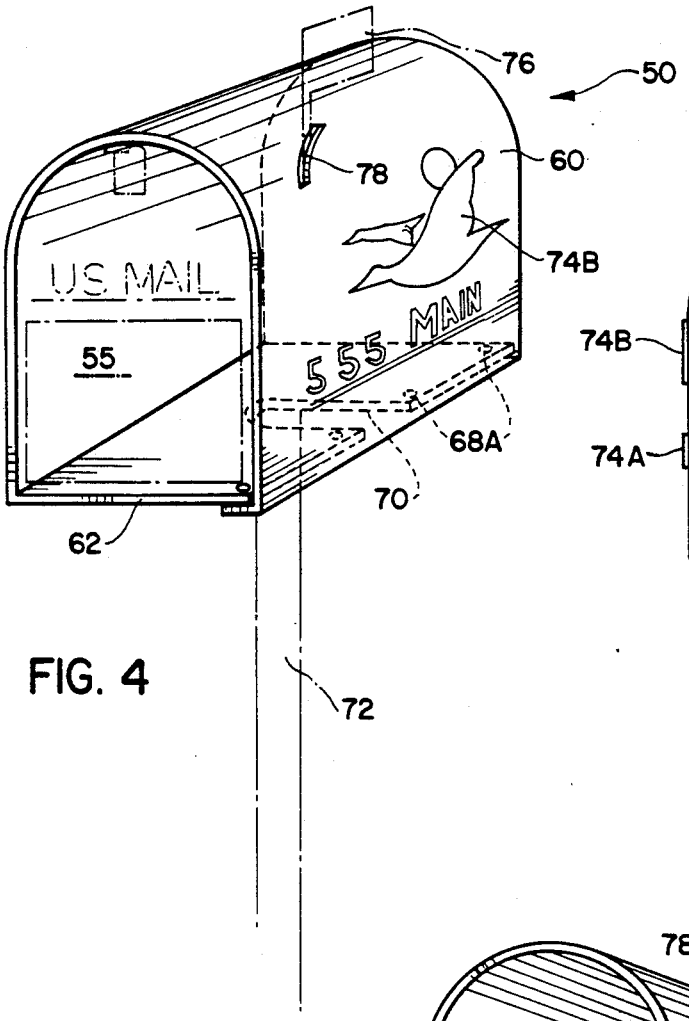
FIG. 4 shows an environmental perspective view of the second embodiment of the present invention.
Figure 5:
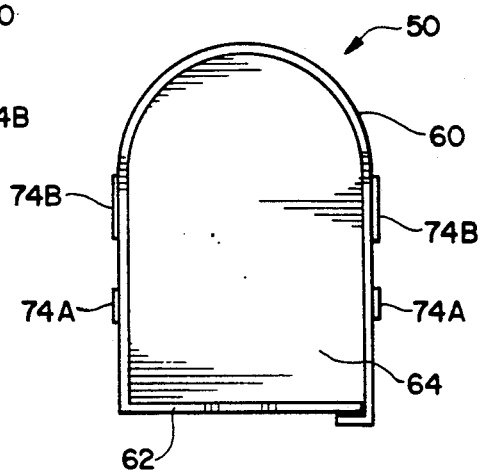
FIG. 5 shows a front view of the second embodiment of the instant invention.
Figure 6:
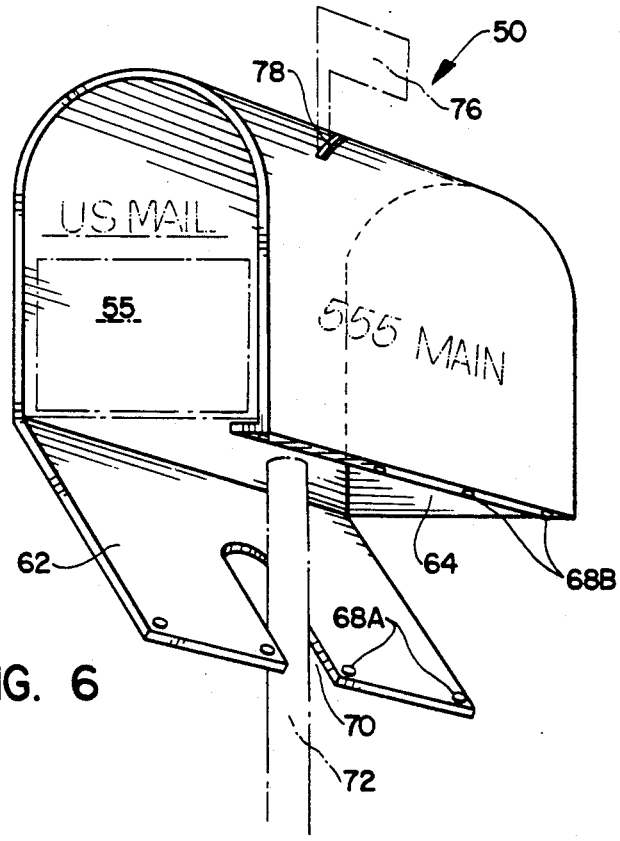
FIG. 6 shows a perspective view of the second embodiment of the instant invention showing the undersection being brought up to cover the bottom of the mailbox.

Now, referring to FIGS. 4–6 and 8, a second embodiment of the mailbox cover 50 is provided which just encircles the mailbox 55. The cover 50 is comprised of a first generally rectangular sheet 60, a second generally rectangular sheet 62, and an end sheet 64. The first sheet 60 is designed to receive indicia 74A as well as decorative patterns 74B. The indicia 74A and the patterns 74B could be customized to reflect the name and address of the owner of the mailbox 55 as well as a pattern of their choice. The indicia 74A and patterns 74B could be stitched onto the cloth, providing raised lettering, which is a positive structural element.

A cutout 70 is provided in the second sheet 62 which would permit the cover 50 to come flush to the mailbox 55. The first cutout 70 is dimensioned in such a manner to permit the second sheet 62 to pass by the mailbox post 72 which supports the mailbox 55. This first cutout 70 can be made in such a manner to accommodate any standard mailbox post 72.

A cutout 78 may be provided in the first sheet 60 which would permit the flag indicator 76 to pass through the cover 50 and allow the flag indicator 76 to move through its full range of motion. The cutout 78 is curved and can be made in such a manner to accommodate any standard flag indicator 76.

The second sheet 62 connects to the first sheet 60 adjacent to the intersection of the bottom and the right side of the mailbox 55 by snap connection devices 68A, 68A. In this second embodiment, male snaps 68A located on the second sheet 62 mate with female snaps 68B located on the first sheet 60. This secures the cover 50 firmly to the mailbox 55.

In both the first and second embodiment, the connection means being snap elements are used as an example. The connection means are not to be limited to this as other connection devices, such as hook and loop fasteners, adhesives or zippers may be employed.

The cloth may be chemically treated as is known in the art. For example, treatments to repel water, insects and mildew are known.

It is to be understood that the present invention is not limited to the sole embodiment described above, but encompasses any and all embodiments within the scope of the following claims.

I claim:

1. A weatherproof cloth mailbox covering designed to cover a mailbox, the mailbox comprising a top, a bottom, a right side, a left side, an end wall at one end thereof, and an opening at an opposite end thereof, the mailbox being supported by a post, said covering comprising:

a) a first generally rectangular sheet having an inner surface, an outer surface, a right edge, a left edge, and a rear edge, said first sheet being engagable with the mailbox to substantially cover the top, the right side and the left side of the mailbox;

b) a second generally rectangular sheet having a right edge and a left edge, said left edge being connected to said first sheet adjacent the right side of the mailbox, said second sheet being engagable with the mailbox to substantially cover the bottom of the mailbox;

c) an end sheet being connected to said rear edge of said first sheet, said end sheet being engagable with the end wall of the mailbox to substantially cover the end wall of the mailbox;

d) means defining a cutout in said second sheet, said cutout partially surrounding the post; and e) connecting means for releasable connecting said left edge of said second sheet to said inner surface of said first sheet adjacent to an intersection of the left side and the bottom of the mailbox, whereby said mailbox covering encapsulates the mailbox and indicia may be attached and displayed on said outer surface thereof.

2. The mailbox covering according to claim 1, wherein the mailbox further comprises an indicator flag proximate the right side and wherein said first sheet juxtaposed the right side of the mailbox includes means defining an opening to provide a passage for the indicator flag to penetrate.

3. The mailbox covering according to claim 2, wherein said outer surface of said first sheet has raised indicia stitched thereon.

4. The mailbox covering according to claim 3, wherein said first sheet, when engaged with and covering the mailbox, extends beyond both the right side and the left side of the mailbox and below the bottom of the mailbox to provide a right and left skirt.

5. The mailbox covering according to claim 4, wherein at least one of said skirts has indicia displayed thereon.

6. The mailbox covering according to claim 5, wherein said indicia is comprised of stitching.

7. The mailbox covering according to claim 6, wherein said indicia is raised.

8. The mailbox covering according to claim 7, wherein said connecting means comprises mating male and female snaps.

9. The mailbox covering according to claim 7, wherein said connecting means comprises mating hook and loop type fasteners.

10. The mailbox covering according to claim 7, wherein said first sheet, including said right and left skirts, displays decorative patterns thereon.

11. The mailbox covering according to claim 10, wherein said decorative pattern is comprised of stitching.

12. The mailbox covering according to claim 11, wherein said decorative pattern is raised.

* * * * *